US010480547B2

(12) United States Patent
Starkey et al.

(10) Patent No.: US 10,480,547 B2
(45) Date of Patent: Nov. 19, 2019

(54) ELECTRO-MECHANICAL ACTUATION SYSTEM FOR A PISTON-DRIVEN FLUID PUMP

(71) Applicant: Umbra Cuscinetti, Incorporated, Everett, WA (US)

(72) Inventors: Benjamin Starkey, Seattle, WA (US); David J. Manzanares, Snohomish, WA (US)

(73) Assignee: UMBRA CUSCINETTI, INCORPORATED, Everett, WA (US)

( * ) Notice: Subject to any disclaimer, the term of this patent is extended or adjusted under 35 U.S.C. 154(b) by 92 days.

(21) Appl. No.: 15/828,177

(22) Filed: Nov. 30, 2017

(65) Prior Publication Data

US 2019/0162210 A1 May 30, 2019

(51) Int. Cl.
*F15B 15/18* (2006.01)
*F15B 15/20* (2006.01)
(Continued)

(52) U.S. Cl.
CPC ..... *F15B 15/18* (2013.01); *F04B 49/06* (2013.01); *F15B 15/20* (2013.01); *F04B 9/10* (2013.01);
(Continued)

(58) Field of Classification Search
CPC ..... F04B 7/0076; F04B 49/06; F04B 49/065; F04B 19/00; F04B 49/20; F15B 15/18
See application file for complete search history.

(56) References Cited

U.S. PATENT DOCUMENTS 4,352,636 A 10/1982 Patterson et al.
4,552,513 A 11/1985 Miller et al.
(Continued)

FOREIGN PATENT DOCUMENTS

CN 102052275 A 5/2011
CN 102367788 A 3/2012
(Continued)

OTHER PUBLICATIONS

ISA Korean Intellectual Property Office, International Search Report and Written Opinion Issued in Application No. PCT/US2018/063101, dated Mar. 19, 2019, WIPO, 14 pages.

*Primary Examiner* — Thomas E Lazo
(74) *Attorney, Agent, or Firm* — Alleman Hall Creasman & Tuttle LLP

(57) ABSTRACT

An electro-mechanical actuation system for a piston-driven fluid pump. The electro-mechanical actuation system includes a plurality of electro-mechanical actuators, and a control system electrically connected to the plurality of electro-mechanical actuators. Each electro-mechanical actuator is configured to operatively couple with a piston of the fluid pump. The control system is configured to determine a target output of fluid to be pumped by the fluid pump, individually control a speed and a phase at which each electro-mechanical actuator actuates the piston, such that the plurality of cylinders collectively pump fluid at an actual output that corresponds to the target output, and in response to detecting an operating condition, individually adjust the speed and/or the phase at which one or more of the electro-mechanical actuators actuates the piston based on the operating condition to thereby cause the actual output of the fluid pump to correspond to an updated target output.

28 Claims, 6 Drawing Sheets

(51) Int. Cl.

| | |
|---|---|
| ***F04B 49/06*** | (2006.01) |
| *F04B 9/10* | (2006.01) |
| *F04B 53/16* | (2006.01) |
| *F04B 53/10* | (2006.01) |

(52) U.S. Cl.
CPC ..... *F04B 53/10* (2013.01); *F04B 53/16* (2013.01); *F15B 2015/206* (2013.01)

(56) References Cited

U.S. PATENT DOCUMENTS

| | | | | |
|---|---|---|---|---|
| 5,108,264 | A | 4/1992 | Abdel-Rahman | |
| 5,634,779 | A | 6/1997 | Eysymontt | |
| 2008/0109152 | A1 | 5/2008 | Puckett | |
| 2009/0053072 | A1* | 2/2009 | Borgstadt | F04B 15/02 417/17 |
| 2009/0241911 | A1 | 10/2009 | Fox et al. | |
| 2010/0097040 | A1* | 4/2010 | Boisvert | F15B 7/008 322/40 |
| 2010/0260615 | A1 | 10/2010 | Anderson et al. | |
| 2011/0002802 | A1* | 1/2011 | Capone | F04B 7/00 417/486 |
| 2011/0289911 | A1* | 12/2011 | Vonderwell | F15B 7/006 60/431 |
| 2012/0011997 | A1 | 1/2012 | Stephenson et al. | |
| 2014/0127037 | A1* | 5/2014 | Uchida | F04B 11/005 417/53 |
| 2014/0199187 | A1 | 7/2014 | Schedgick et al. | |
| 2015/0157789 | A1 | 6/2015 | Capone et al. | |
| 2015/0260181 | A1 | 9/2015 | Harvey | |
| 2015/0314254 | A1 | 11/2015 | Benassi et al. | |
| 2016/0208793 | A1 | 7/2016 | Kroeger et al. | |

FOREIGN PATENT DOCUMENTS

| | | | | |
|---|---|---|---|---|
| CN | 103939742 | A | 7/2014 | |
| DE | 3939146 | A1 | 5/1991 | |
| DE | 10032793 | A1 | 1/2002 | |
| EP | 2083171 | A1 * | 7/2009 | F04B 9/02 |
| JP | 2010101170 | A | 5/2010 | |
| WO | 2007029009 | A1 | 3/2007 | |

* cited by examiner

ELECTRO-MECHANICAL ACTUATION SYSTEM FOR A PISTON-DRIVEN FLUID PUMP

BACKGROUND

In large-scale fluid systems, a fluid user may consume fluid at a high flow rate and a high pressure. Large-scale fluid systems may be implemented in a variety of applications including mining, construction, marine, and others. Typically, in such large-scale fluid systems, a fluid is stored in a storage tank, and pumped by a fluid pump at a high flowrate (e.g., 50-100 gallons/minute) and a high pressure (e.g., 5,000 PSI) to a fluid user.

In one example, a fluid pump includes a plurality of pump pistons that are driven by a crankshaft to pump the fluid from the storage tank to the fluid user. The speed at which the crankshaft drives the pump pistons is sinusoidal in nature due to the shape of the crankshaft. The flow rate and output pressure of the pump system are proportional to the speed of the crankshaft. As such, the flowrate and output pressure of the pump system fluctuate in accordance with the sinusoidal characteristics of the crankshaft. Such fluctuations result in a ripple effect that disrupts fluid delivery to the fluid user. Moreover, because operation of all the pump pistons are linked to rotation of the crankshaft, the pump system is incapable of independently controlling any particular one or more of the pump pistons to compensate for ripple effects or any other dynamic changes in operating conditions.

DETAILED DESCRIPTION

As discussed above, a crankshaft-driven pump system may deliver fluid to a fluid user in an inconsistent and disruptive manner. Furthermore, such a crankshaft-driven pump system may have limited control flexibility to compensate for dynamic changes in operating conditions.

Accordingly, the present description is directed to a multi-channel, electro-mechanical actuation system for a piston-driven fluid pump having a plurality of cylinders. Each cylinder includes a piston operable to reciprocate within the cylinder to pump a fluid. Each electro-mechanical actuator is operatively coupled to a corresponding piston. The control system is configured to determine a target output of fluid to be pumped by the fluid pump, individually control a speed and a phase at which each electro-mechanical actuator actuates a corresponding piston, such that the plurality of cylinders collectively pump fluid at an actual output that corresponds to the target output. Furthermore, the control system is configured to detect various operating conditions, and in response to detecting an operating condition individually adjust the speed and/or the phase at which one or more of the electro-mechanical actuators actuates the corresponding piston based on the detected operating condition to thereby cause the actual output of the fluid pump to correspond to an updated target output. In some implementations, the control system controls the electro-mechanical actuators to minimize ripple of the actual output.

Such a configuration may allow for highly granular control of the fluid pump. For example, the control system may be configured to adjust operation of the fluid pump in a manner that allows for a high turn-down ratio of the fluid pump (e.g., from a flow rate of 50 g/m down to 1 g/m) based on a detected operating condition, such as a reduced flow demand. In particular, the control system may deactivate one or more of the electro-mechanical actuators, and adjust the speed and/or phase and/or profile of one or more of the other electro-mechanical actuators to achieve an actual output that corresponds to an updated target output. Moreover, such a configuration may provide redundancy in case of degradation. For example, the control system may detect degradation of one or more electro-mechanical actuators and/or corresponding pistons, and adjust the speed and/or phase of one or more of the other non-degraded electro-mechanical actuators (and/or the degraded electro-mechanical actuator if it is still partially operational) to achieve an actual output that corresponds to an updated target output. Note that the updated target output may be the same as the target output determined prior to detecting the operating condition, or the updated target output may differ from the target output determined prior to the detecting the operating condition.

Figure 1:
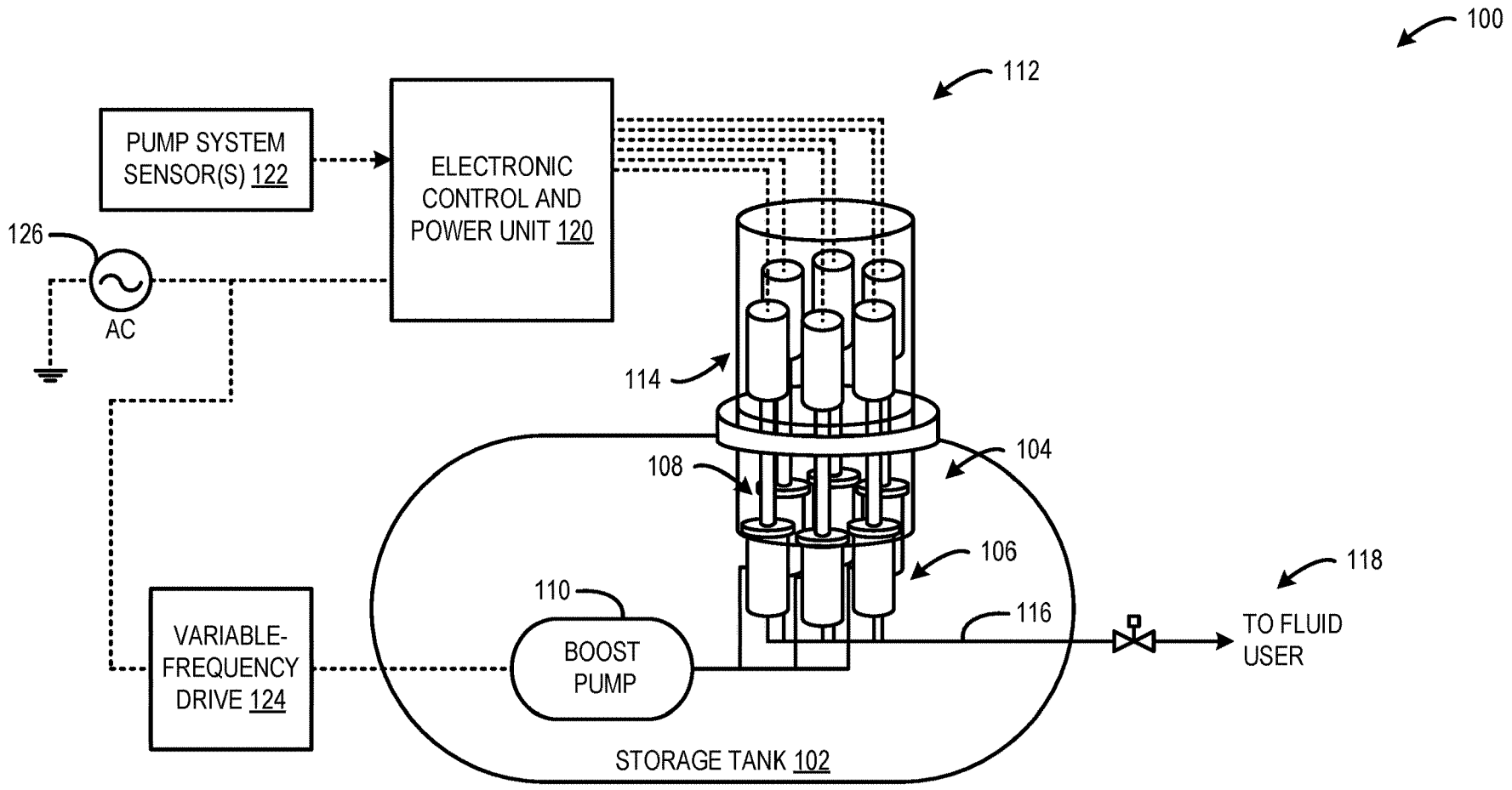
FIG. 1 shows an example pump system.

FIG. 1 shows an example pump system 100. Pump system 100 may be incorporated into any suitable implementation that involves large-scale fluid consumption by a fluid user. As used herein, a fluid user includes any type of engine, power plant, prime mover, fluid jet drive or other machine that consumes fluid output from pump system 100.

Pump system 100 includes a storage tank 102 configured to hold a fluid. Storage tank 102 may hold any suitable fluid including water and liquid nitrogen (LN). Storage tank 102 may be sized to hold any suitable amount of fluid in a liquid state. In some implementations, the storage tank may be configured to hold a cryogenic fluid.

A fluid pump 104 is operatively coupled to the storage tank 102. Fluid pump 104 includes a plurality of high-pressure cylinders 106 submerged in storage tank 102 to interface with the fluid. Each cylinder 106 includes a piston 108 that is configured to reciprocate within the cylinder 106 to pump the fluid from storage tank 102. Fluid pump 104 may include any suitable number of cylinders 106. Note that fluid pump 104 must include at least two cylinders in order to provide an output with minimized ripple. In the depicted example, fluid pump 104 includes six cylinders.

An optional boost pump 110 is positioned within storage tank 102. Boost pump 110 is connected to an inlet valve 218 (shown in FIG. 2) of each cylinder 106. Boost pump 110 is configured to supply fluid from storage tank 102 into cylinders 106 at a designated input pressure to ensure that cylinder 106 has sufficient net positive suction pressure to produce high-pressure output and prevent cavitation. Boost pump 110 may be powered by a variable-frequency drive 124.

An electro-mechanical actuation system 112 is positioned external to storage tank 102. Electro-mechanical actuation system 112 includes a plurality of electro-mechanical actuators 114. Each electro-mechanical actuator 114 is operatively coupled to a corresponding piston 108 of the plurality of cylinders 106. Each electro-mechanical actuator 114 is configured to exert controlled, reciprocating force to the corresponding piston 108 to cause the corresponding cylinder 106 to produce high-pressure flow of fluid from storage tank 102. Generally, electro-mechanical actuators 114 control pistons 108 to fully extend and retract within cylinders 106 in order to maximize volumetric efficiency of fluid pump 104. Electro-mechanical actuation system 112 may include any suitable number of electro-mechanical actuators corresponding to the number of cylinders 106 of fluid pump 104. In the depicted example, electro-mechanical actuation system 112 includes six electro-mechanical actuators 114 corresponding to the six cylinders 106 of fluid pump 104.

Figure 2:
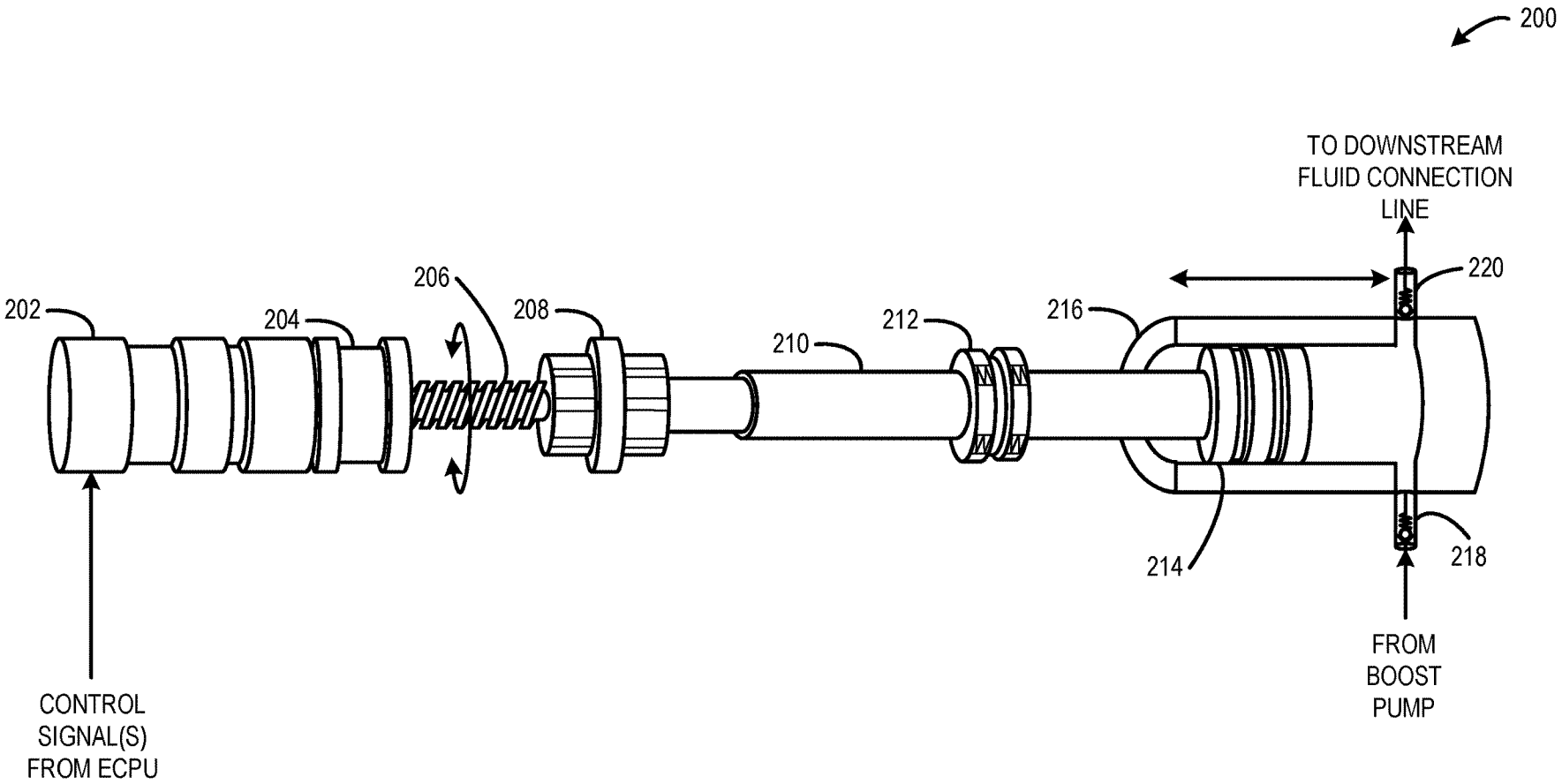
FIG. 2 shows an example electro-mechanical actuator assembly operatively coupled to a pump piston and cylinder assembly.

FIG. 2 shows an example electro-mechanical actuator assembly 200. Electro-mechanical actuator assembly 200 is representative of each channel of electro-mechanical actuation system 112 of FIG. 1. Assembly 200 includes an electric motor 202 configured to generate an output torque based on control signal(s) received from the ECPU 120 of FIG. 1. Electric motor 202 may be any suitable type of electric motor. In one example, electric motor 202 is a permanent magnet servo-motor. Electric motor 202 is operatively connected to a gear box 204, and gear box 204 is further connected to a ball screw 206. Gear box 204 is configured to increase the output torque of electric motor 202 that is applied to rotate ball screw 206. In some implementations, the gear box may be omitted, and the ball screw may be driven directly by the motor. A ball nut 208 is threaded onto ball screw 206 such that when electric motor 202 rotates ball screw 206 in one direction, ball nut 208 moves towards electric motor 202. On the other hand, when electric motor 202 rotates ball screw 206 in the opposing direction, ball nut 208 moves away from electric motor 202. An output rod 210 is coupled to ball nut 208. Output rod 210 extends as ball nut 208 moves away from electric motor 202, and retracts as ball nut 208 moves towards electric motor 202. Output rod 210 is coupled to a compliant coupling 212. Compliant coupling 212 is further coupled to a piston 214 positioned in a cylinder 216. Compliant coupling 212 is configured to absorb energy from electric motor 202 in the event that piston 214 bottoms out or hits a hard stop in cylinder 216 in order to inhibit degradation of piston 214 and/or other components of assembly 200. In other implementations, the compliant coupling may be replaced by a torque limiter. In yet other implementations, the compliant coupling may be omitted from the assembly.

Cylinder 216 includes inlet valve 218 and an outlet valve 220. Inlet valve 218 is operable to allow fluid to flow into cylinder 216 from a fluid connection line with boost pump 110 (shown in FIG. 1). In the depicted example, inlet valve 218 opens during a retract stroke of piston 214. Outlet valve 220 is operable to allow fluid to flow out of cylinder 216 to a downstream fluid connection line 116 (shown in FIG. 1). In the depicted example, outlet valve 220 opens during an extend stroke of piston 214.

It will be appreciated that the depicted configuration is provided as an example, and other configurations may be contemplated. In some implementations, the cylinder may include additional inlet valve(s) and/or outlet valve(s) to enable pumping of fluid on both extend strokes and retract strokes. In some implementations, another gear train may be used instead of the ball screw and nut configuration. For example, a rack and pinion gear may be used in the assembly. The output torque of electric motor 202 may be translated into reciprocation of piston 214 in cylinder 216 via any suitable intermediate gear train or other linkage.

Returning to FIG. 1, fluid pump 104 is fluidly connected to a fluid user 118 via the downstream fluid connection line 116.

In some implementations, storage tank 102 may be a primary storage tank, and pump system 100 may include a sump tank that is separate from primary storage tank 102. In such implementations, fluid pump 104 may be connected to the sump tank instead of primary storage tank 102. Fluid may flow from storage tank 102 to the sump tank, and fluid pump 104 may pump the fluid from the sump tank to fluid user 118.

Electro-mechanical actuation system 112 includes a control system, also referred to herein as an electronic control and power unit (ECPU) 120. ECPU is electrically connected to the plurality of electro-mechanical actuators 114. ECPU 120 is configured to monitor operating conditions and performance of pump system 100, and dynamically adjust operation of electro-mechanical actuators 114 based on the detected operating conditions. ECPU 120 is configured to provide power to a motor of each electro-mechanical actuator 114 in order to individually control actuation of each corresponding piston 108 to control an output flow rate and output pressure of each cylinder 106.

ECPU 120 includes a processor, volatile memory, and non-volatile memory. The processor is configured to execute instructions that are part of one or more applications, programs, routines, libraries, objects, components, data structures, or other logical constructs. Such instructions may be implemented to perform a task, implement a data type, transform the state of one or more components, achieve a technical effect, or otherwise arrive at a desired result.

The processor is typically configured to execute software instructions that are stored in non-volatile memory using portions of volatile memory. Additionally or alternatively, the processor may include one or more hardware or firmware processors configured to execute hardware or firmware instructions. The processor may be single-core or multi-core, and the instructions executed thereon may be configured for sequential, parallel, and/or distributed processing.

Non-volatile memory is configured to hold software instructions even when power is cut to the ECPU, and may include optical memory (e.g., CD, DVD, HD-DVD, Blu-Ray Disc, etc.), solid state memory (e.g., EPROM, EEPROM, FLASH memory, etc.), and/or magnetic memory (e.g., hard-disk drive, floppy-disk drive, tape drive, MRAM, etc.), among others.

Volatile memory is configured to hold software instructions and data temporarily during execution of programs by the processor, and typically such data is lost when power is cut to the device. Examples of volatile memory that may be used include RAM, DRAM, etc.

Aspects of processor, non-volatile memory, and volatile memory may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

ECPU 120 and variable-frequency drive 124 are powered by an alternating current power source 126.

ECPU 120 is configured to receive signals from a plurality of pump system sensors 122. The sensor signals indicate aspects of various operating conditions/states of pump system 100. Sensors 122 may provide feedback of any suitable aspect of operation of pump system 100. Example aspects of operating conditions monitored by pump system sensors 122 may include fluid temperature, cylinder output flow rate, cylinder output fluid pressure, total pump output flow rate, total pump output fluid pressure, cylinder valve position/state, fluid input flow rate, fluid input pressure, electro-mechanical actuator position/speed/phase/acceleration/torque, motor temperature, and lube oil temperature. ECPU 120 may be configured to determine an operating state and/or operating conditions of pump system 100 based on feedback from sensors 122.

Furthermore, ECPU 120 is configured to receive information from fluid user 118, and control operation of the plurality of electro-mechanical actuators 114 based on such information. In one example, ECPU 120 receives information related to a target amount of fluid required by the fluid user 118 to generate an output (e.g., pressure, engine speed, electrical current). ECPU 120 determines a target output (e.g., a target flow rate and target output pressure) of fluid pump 104 to provide the target amount of fluid to fluid user 118, and individually controls the plurality of electro-mechanical actuators 114 such that fluid pump 104 outputs an actual output (e.g., an actual flow rate and an actual fluid pressure) that corresponds to (e.g., is within a threshold tolerance of) the target output (e.g., the target flow rate and the target fluid pressure). In particular, ECPU 120 controls a speed and a phase of each electro-mechanical actuator 114 such that each cylinder provides an individual output. The sum of the individual outputs of the plurality of cylinders 106 represents a total output of fluid pump 104.

Note that ECPU 120 may individually control each electro-mechanical actuator 114 such that fluid pump 104 provides any suitable output. Moreover, the output of fluid pump 104 may be characterized by any suitable parameter. Examples of parameters that characterize the output of fluid pump 104 include flow rate, fluid pressure, total flow, and other parameters.

As used herein, the phase of an electro-mechanical actuator means a timing offset or sequencing at which a pump stroke of a piston in a cylinder occurs relative to other pistons in other cylinders of the fluid pump. The phase may be characterized in terms of degrees, where one pump stroke cycle is equivalent to three hundred sixty degrees. For example, pistons may be phased such that, at time T1, an end of an extend stroke of a first piston occurs and an end of a retract stroke of a second piston also occurs. Subsequently, at time T2, an end of a retract stroke of the first piston occurs and an end of an extend stroke of the second piston also occurs. In this example, a phase of the second piston is said to be one hundred and eighty degrees offset from a phase of the first piston. Such phasing of the first and second pistons minimizes ripple in the output flow rate of fluid pump 104, because each time a retract stroke occurs an extending pump stroke also occurs such that the output flow rate is substantially constant. Note that a piston may be phased differently depending on a number of active electro-mechanical actuators of fluid pump 104 in order to minimize ripple. Ripple minimization control may be achieved by adjusting one or more additional operating factors including overlap between start of one actuator's stroke and the end of another actuator's stroke to compensate for the time required for check valves of the cylinder to open/close. Further, phase offsets between actuators may vary with pump speed to minimize ripple. Fluid compressibility is another operating factor that may be used to determine phase offsets and overlap for the actuators to minimize ripple.

ECPU 120 may control the phasing of the plurality of electro-mechanical actuators 114 to minimize ripple in the output of fluid pump 104 across various operating conditions of pump system 100. ECPU 120 minimizes ripple by individually controlling each electro-mechanical actuator 114 such that when each corresponding piston of the plurality of pistons 108 is at an end of an extend stroke another piston is at an end of a retract stroke. In the depicted example, ECPU 120 controls the phasing of the plurality of electro-mechanical actuators 114 such that four actuators are always extending at one rate while two actuators are always retracting at approximately double the extend rate of the other four actuators. Each time one actuator reaches its extend end of stroke another actuator reaches its retract end of stroke.

As discussed above, ECPU 120 is configured to receive information from sensors 122 as well as fluid user 118. Further, ECPU 120 is configured to detect operating conditions of pump system 100 based on such sensor feedback.

In some cases, ECPU 120 may deactivate or reduce output of one or more electro-mechanical actuator channels and/or detect an operating condition in which one or more electro-mechanical actuator channels is deactivated or has reduced output based on such feedback. In some such cases, ECPU 120 may detect an operating condition in which one or more electro-mechanical actuators and/or corresponding pistons/cylinders is degraded. ECPU 120 may deactivate the degraded electro-mechanical actuator(s) in response to detecting the operating condition. Such an operating condition may be detected based on various types of feedback. For example, ECPU 120 may detect such an operating condition based on a motor temperature of an electro-mechanical actuator being above a threshold that indicates overheating of actuator. In another example, ECPU 120 may detect such an operating condition based on a detected speed or position of an actuator differing by greater than a threshold tolerance from an expected speed or position. In another example, ECPU 120 may detect such an operating condition based on an actual output (e.g. a flow rate and/or fluid pressure) of a corresponding cylinder varying by greater than a threshold tolerance from an expected output.

In another example, ECPU 120 may deactivate one or more electro-mechanical actuators and/or detect an operating condition in which one or more of the electro-mechanical actuators is deactivated in order to reduce a total output of fluid pump 104 to correspond to a lower target output. Such operation may be referred to as a turn-down ratio of fluid pump 104. In other words, the turn-down ratio may indicate the ratio of the fastest speed at which a pump can operate to a slowest speed the pump can operate. By deactivating the electro-mechanical actuators, a greater turn-down ratio can be achieved. In an example where the fluid user is an engine, the target output may be reduced when the engine is in an idle condition, because the engine combusts a reduced amount of fluid. For example, the target flow rate may go from fifty gallons per minute to one gallon per minute when the engine is idling.

Upon detecting an operating condition, ECPU 120 is configured to individually adjust operation of each activated electro-mechanical actuator 114 based on the detected operating condition. In particular, ECPU 120 is configured to adjust each actuator 114, such that the plurality of cylinders 106 collectively pump the fluid from storage tank 102 at an updated actual output (e.g., an updated actual flow rate and/or an updated actual fluid pressure) that corresponds to an updated target output. In some implementations, ECPU 120 individually controls each actuator 114 to further minimize ripple in the updated actual output.

In some cases, the detected operating condition is a deactivated/degraded electro-mechanical actuator and/or piston and the updated target output is the same as the previous target output that was determined prior to detecting the operating condition. To maintain the same output with less activated electro-mechanical actuators, ECPU 120 increases the speed of each of the activated electro-mechanical actuators. Furthermore, ECPU 120 adjusts the phase of each activated electro-mechanical actuator, such that the pump strokes of the corresponding pistons remain aligned (e.g., an end of an extend stroke of one piston occurs at the same time as an end of a retract stroke of another piston) in order to minimize ripple and provide a steady output.

In another example, if a degraded piston produces less flow than the others due to degradation (e.g., piston seal blow-by or fluid leakage back out through the inlet check valves), then ECPU 120 may increase the speed of the actuator associated with the affected piston to minimize flow variation (e.g., ripple) through the cycle of actuator extensions.

In some cases, ECPU 120 may operate each electro-mechanical actuator at a maximum operational speed during normal operating conditions. In other words, the electro-mechanical actuators operate as fast as allowable, and thus the speed of the electro-mechanical actuators cannot be increased any further. As such, when ECPU 120 detects an operating condition where one or more electro-mechanical actuators and/or pistons is deactivated/degraded, the updated target output is less than the previous target output that was determined prior to detecting the operating condition. This is because all of the electro-mechanical actuators are operating as fast as allowable, and now there are less activated electro-mechanical actuators. In this case, ECPU 120 may adjust the phase of the remaining activated electro-mechanical actuators without adjusting the speed. In one example, ECPU 120 adjusts the phase of each activated electro-mechanical actuator, such that the pump strokes of the corresponding pistons remain aligned (e.g., an end of an extend stroke of one piston occurs at the same time as an end of a retract stroke of another piston) in order to minimize ripple and provide a steady output.

In some cases, electro-mechanical actuation system 112 and/or fluid pump 104 is configured to operate with a designated backup electro-mechanical actuator channel that is used in case of degradation of another electro-mechanical actuator channel. Applying this concept to the depicted six-channel example, the electro-mechanical actuation system may normally operate with five active channels and one backup channel may remain deactivated during normal operating conditions. If one of the active channels becomes degraded, then ECPU 120 activates the backup channel in response to detecting degradation of the other channel. In such a configuration, the channel that is designated as the backup may rotate periodically between the six electro-mechanical actuator channels, so that all of the electro-mechanical actuator channels have an equivalent level of wear.

ECPU 120 may dynamically, individually adjust operation of each of the plurality of electro-mechanical actuators 114 in any suitable manner based on a detected operating condition. Such dynamic, individual control of the electro-mechanical actuators allows fluid pump 104 to achieve a steady output with minimized ripple even as operating conditions vary.

ECPU 120 may dynamically, individually adjust operation of each of the plurality of electro-mechanical actuators 114 in any suitable manner based on a detected operating condition in which one or more electro-mechanical actuators is deactivated. Furthermore, ECPU 120 may dynamically, individually adjust operation of each of the plurality of electro-mechanical actuators 114 in any suitable manner based on a detected operating condition in which one or more electro-mechanical actuators is re-activated. For example, when an electro-mechanical actuator is brought back online after routine maintenance is performed, the ECPU 120 may detect activation of the electro-mechanical actuator, and adjust each activated electro-mechanical actuator based on the detected activation in order to provide a steady output of fluid pump 104.

FIGS. 3-11 show different graphs that characterize operation of a plurality of electro-mechanical actuators of an electro-mechanical actuation system for a fluid pump, such as fluid pump 104 of FIG. 1, during different operating conditions. In particular, the illustrated graphs characterize how electro-mechanical actuators can be dynamically, individually controlled in response to changes in operating conditions in order to provide a steady output while minimizing ripple.

Figure 3:
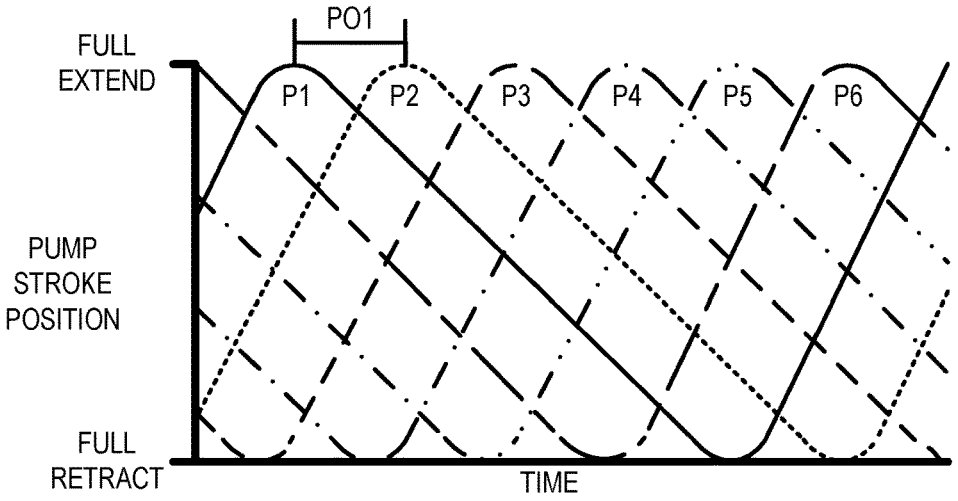
FIG. 3 shows an example position vs time graph depicting operation of all six channels of a six-channel electro-mechanically driven pump system.
Figure 4:
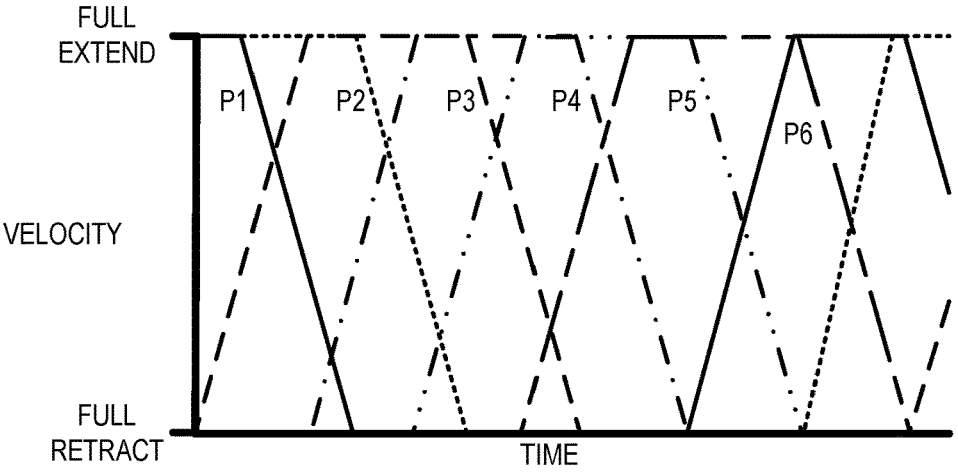
FIG. 4 shows an example velocity vs time graph depicting operation of all six channels of a six-channel electro-mechanically driven pump system.
Figure 5:
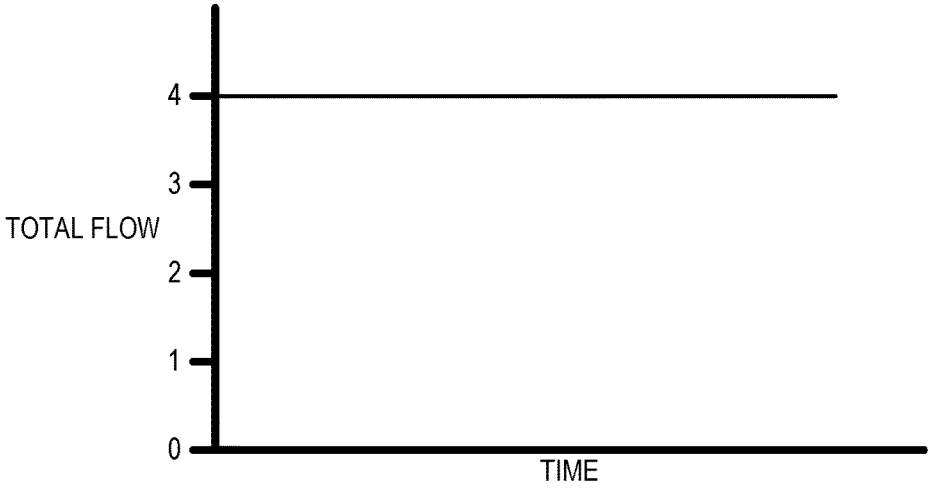
FIG. 5 shows an example total flow vs time graph depicting operation of all six channels of a six-channel electro-mechanically driven pump system.

FIGS. 3-5 show graphs that characterize operation of the electro-mechanical actuation system for the fluid pump when all six electro-mechanical actuator channels are activated. FIG. 3 shows a pump piston position vs time graph. A pump stroke cycle of each activated piston of the fluid pump is represented by a different visual pattern (i.e., piston 1 (P2): solid line, piston 2 (P2): dotted line, piston 3 (P3): dashed line, piston 4 (P4): dot-dashed line, piston 5 (P5): double-dot-dashed line, piston 6 (P6): double-dashed line) on the graph. The different pump pistons are operated according to a designated order. The depicted order is provided as an example, and the pump pistons may be operated according to any suitable order. The pump stroke cycle of each pump piston includes an extend stroke and a retract stroke. Each pump stroke in the cycle is linear, and each cycle is repeated at a constant rate (e.g., 100 cycles/minute). This indicates that each piston is operated at a constant speed during the majority of each stroke of the cycle. Further, the cycle of each active pump piston is temporally spaced apart from a cycle of a next pump piston in the designated order according to a first phase offset (PO1). In other words, all of the cycles of activated pistons are evenly spaced apart by the same phase offset. In order to minimize ripple of the output of the fluid pump, the phase offset of each pump piston is substantially the same, and the pump stroke cycle of each piston mirrors the pump stroke cycle of another piston. In other words, one piston is in an extend stroke (moving toward a peak of the cycle on the graph) when another piston is in a retract stroke (moving toward a valley of the cycle on the graph). In the illustrated example, the phase of the pistons is set such that two pistons (e.g., P1, P2) are extending while another piston (e.g., P6) is retracting.

FIG. 4 shows a pump piston velocity vs time graph. This graph illustrates the acceleration and deceleration of each pump piston during the extend and retract strokes of the pump stroke cycles. The six pump pistons operate according to the same designated order as shown in the graph of FIG. 3. In the illustrated example, each pump piston outputs a flow of 1 unit during an extend stroke and zero units during a retract stroke. Note that the unit is arbitrary for this example and could be representative of any suitable unit of flow. Further, the accelerations of the different pump pistons are matched. In particular, when one pump piston is accelerating during an extend stroke another piston is decelerating during a retract stroke. This matched acceleration is achieved by controlling all the pump pistons with the same phase offset (PO1) such that the pump stroke cycles of all the pump pistons are evenly spaced apart.

FIG. 5 shows a total flow vs time graph. This graph characterizes the total output flow rate of the fluid pump when all six pump pistons are activated and operating according to the graphs of FIGS. 3 and 4. In particular, the total flow of the fluid pump is constant at 4 units. Although each activated pump piston is capable of providing 1 unit of flow, because the pump pistons are controlled such that four pump pistons are extending when two pump pistons are retracting only 4 total units of flow are output from the fluid pump. As discussed above, this control scheme is implemented to minimize ripple in the output of the fluid pump.

Figure 6:
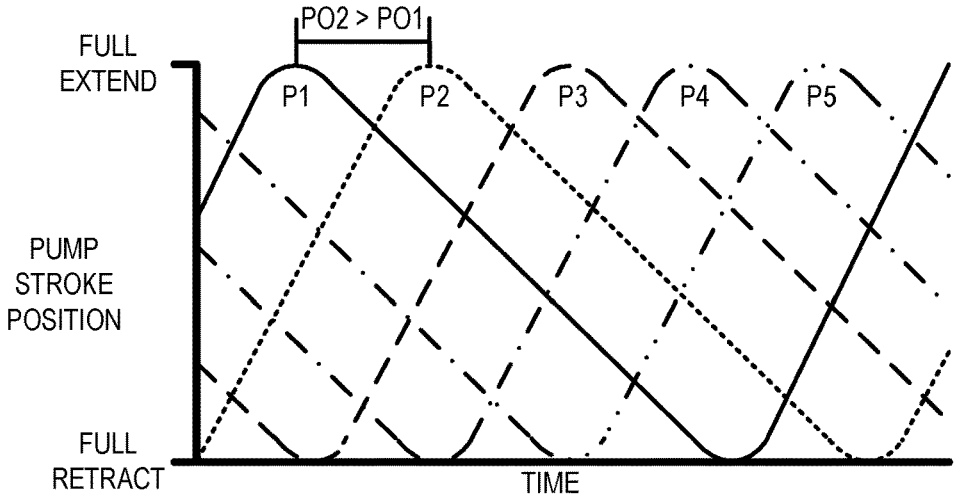
FIG. 6 shows an example position vs time graph depicting operation of five of six channels of a six-channel electro-mechanically driven pump system having a reduced total flow rate.
Figure 7:
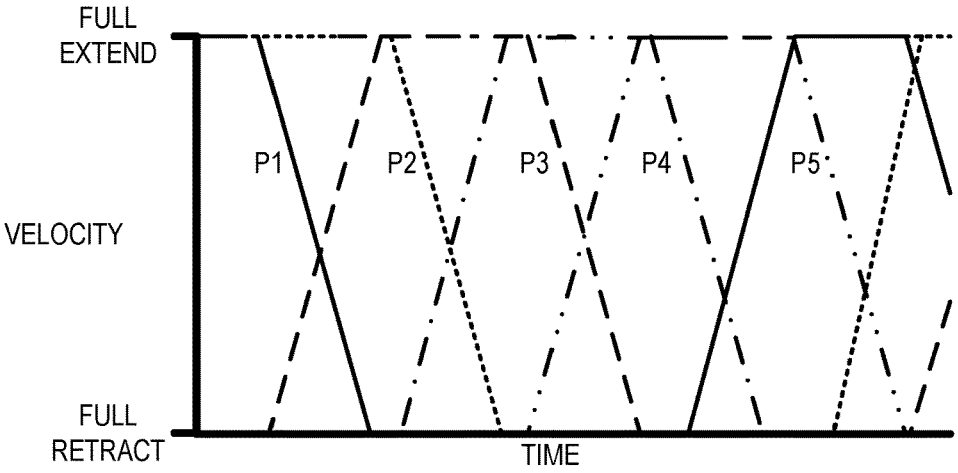
FIG. 7 shows an example velocity vs time graph depicting operation of five of six channels of a six-channel electro-mechanically driven pump system having a reduced total flow rate.
Figure 8:
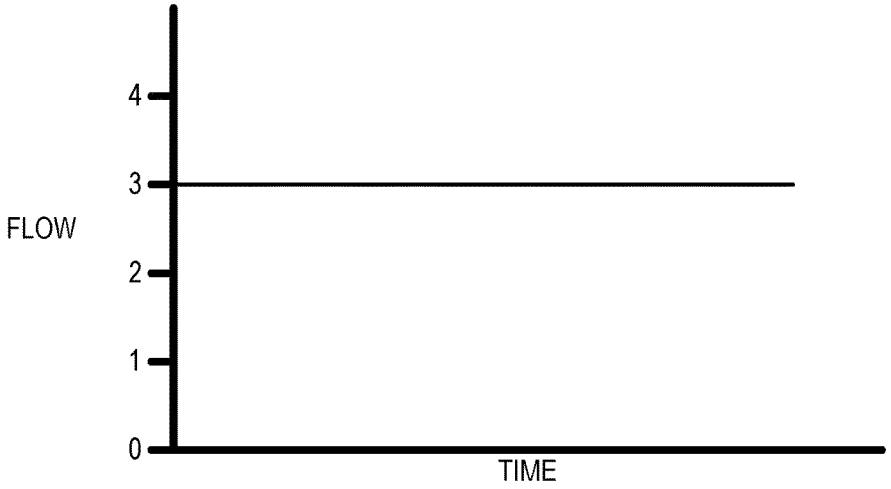
FIG. 8 shows an example total flow vs time graph depicting operation of five of six channels of a six-channel electro-mechanically driven pump system having a reduced total flow rate.

FIGS. 6-8 show graphs that characterize operation of the electro-mechanical actuation system of the fluid pump when five of six electro-mechanical actuator channels are activated. As discussed above, operation of the fluid pump may be controlled in this manner based on detecting any of a variety of operating conditions including degradation of an electro-mechanical actuator channel. In the illustrated example, the actual output of the fluid pump is reduced relative to when all six electro-mechanical actuators are activated. In particular, each electro-mechanical actuator is controlled to provide the same output flow as when all channels were activated, but in this case one less pump piston is activated. In other words, the cycle time to perform a pump stroke is maintained at the same duration. Such operation may represent a control scheme where each electro-mechanical actuator channel is operated at a maximum operational flow rate during normal operation of the fluid pump.

FIG. 6 shows a pump piston position vs time graph. In this example, pump pistons 1-5 (P1-P5) are activated and pump piston 6 is deactivated. Since each pump piston is providing the same output flow, the pump pistons are extending at the same speed as when pump piston 6 was deactivated. In order to maintain a constant output of the fluid pump with minimized ripple, the phase of each of the pump pistons is individually adjusted to have a second phase offset (PO2) that is greater (both in terms of degrees and time) than the first phase offset (PO1). Furthermore, the ratio of extend and retract times (i.e., speed) of one or more of the electro-mechanical actuator is individually adjusted to minimize ripple. In the illustrated example, the retract time is adjusted from ⅓ of the cycle to ⅖ of the cycle. The phase and speed (e.g., extend/retract ratio) of each of the pump pistons is individually adjusted to maintain alignment. In the illustrated example, the phase of the pistons is set such that three pistons (e.g., P1, P2, P3) are extending while two other pistons (e.g., P4, P5) are retracting.

FIG. 7 shows a pump piston velocity vs time graph. This graph illustrates the acceleration and deceleration of each activated pump piston during the extend and retract strokes of the pump stroke cycles. Like before, the activated pump pistons extend at the same speed such that each pump piston outputs a flow of 1 unit. Further, the retract speeds are adjusted such that the different pump pistons are matched.

FIG. 8 shows a total flow vs time graph. This graph characterizes the total output flow rate of the fluid pump when five pump pistons are activated and operating according to the graphs of FIGS. 6 and 7. In particular, the total flow of the fluid pump is constant at 3 units. Although each activated pump piston is capable of providing 1 unit of flow, because the pump pistons are controlled such that three pump pistons are extending when two pump pistons are retracting only 3 total units of flow are output from the fluid pump. As discussed above, this control scheme is implemented to minimize ripple in the output of the fluid pump.

Figure 9:
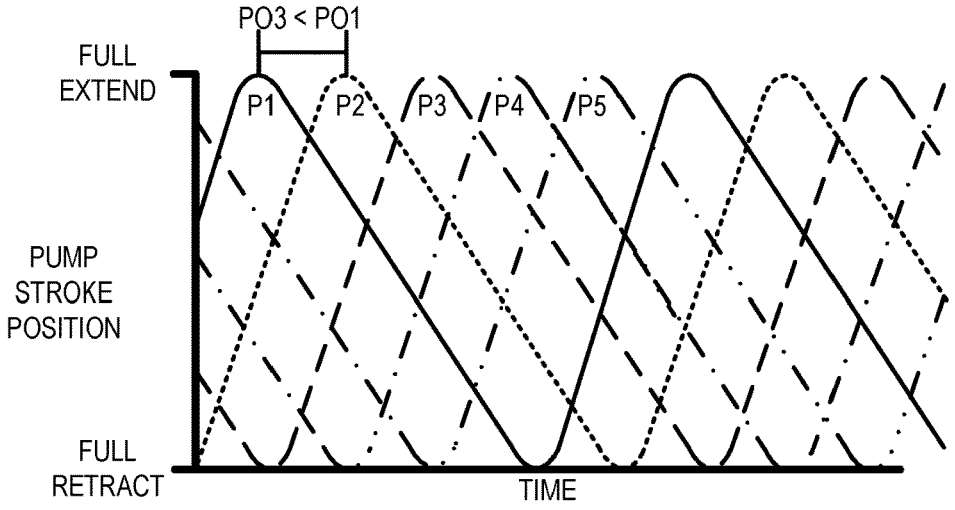
FIG. 9 shows an example position vs time graph depicting operation of five of six channels of a six-channel electro-mechanically driven pump system to maintain a total flow rate.
Figure 10:
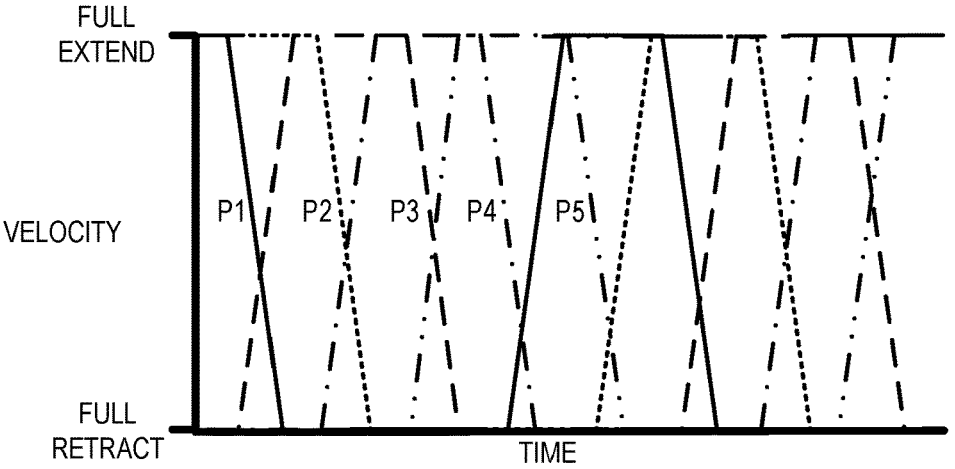
FIG. 10 shows an example velocity vs time graph depicting operation of five of six channels of a six-channel electro-mechanically driven pump system to maintain a total flow rate.
Figure 11:
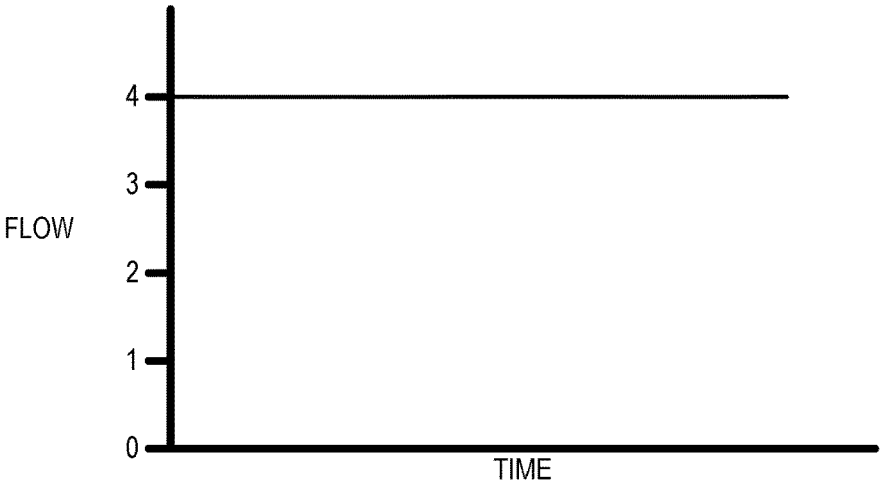
FIG. 11 shows an example total flow vs time graph depicting operation of five of six channels of a six-channel electro-mechanically driven pump system to maintain a total flow rate.

FIGS. 9-11 show graphs that characterize operation of the electro-mechanical actuation system of the fluid pump when five of six electro-mechanical actuator channels are activated and collectively operating to provide the same total output as prior to deactivation of the sixth channel. In the illustrated example, the velocity of each electro-mechanical actuator is increased to provide an increased output relative to when all channels were activated in order to compensate for the deactivated channel. In other words, the cycle time to perform a pump stroke is reduced. Such operation may represent a control scheme where each electro-mechanical actuator channel is operated at less than a maximum operational flow rate during normal operation of the fluid pump.

FIG. 9 shows a pump piston position vs time graph. In this example, pump pistons 1-5 (P1-P5) are activated and pump piston 6 is deactivated. Since each pump piston is providing an increased output flow, the activated pump pistons are operating at an increased speed relative to when pump piston 6 was also activated. Further, in order to maintain a constant output of the fluid pump with minimized ripple, the phase of each of the pump pistons is individually adjusted to have a third phase offset (PO3) the third phase offset is equivalent to the first phase offset (PO1) in terms of degrees. However, since the cycle time is reduced, the third phase offset is less than the first phase offset in terms of units of time. In the illustrated example, the phase of the pistons is set such that three pistons (e.g., P1, P2, P3) are extending while two other pistons (e.g., P4, P5) are retracting.

FIG. 10 shows a pump piston velocity vs time graph. This graph illustrates the acceleration and deceleration of each activated pump piston during the extend and retract strokes of the pump stroke cycles. The activated pump pistons operate at an increased speed in order to compensate for the loss of flow due to the deactivated pump piston. In particular, each activated pump piston outputs a flow of $1.\overline{33}$ units. Further, the accelerations of the different pump pistons are matched.

FIG. 11 shows a total flow vs time graph. This graph characterizes the total output flow rate of the fluid pump when five pump pistons are activated and operating according to the graphs of FIGS. 9 and 10. In particular, the total flow of the fluid pump is constant at 4 units. In this example, the speed of each of the pump pistons is increased in order to maintain the same total output flow even when a channel of the fluid pump is deactivated. Moreover, the phase of each activated pump pistons is adjusted such that three pump pistons are extending when two pump pistons are retracting. As discussed above, this control scheme is implemented to minimize ripple in the output of the fluid pump.

Although the above examples describe scenarios where a single electro-mechanical actuator channel of the fluid pump is deactivated, the control concepts are broadly applicable to other scenarios where more than one electro-mechanical actuator channel of the fluid pump is deactivated.

Figure 12:
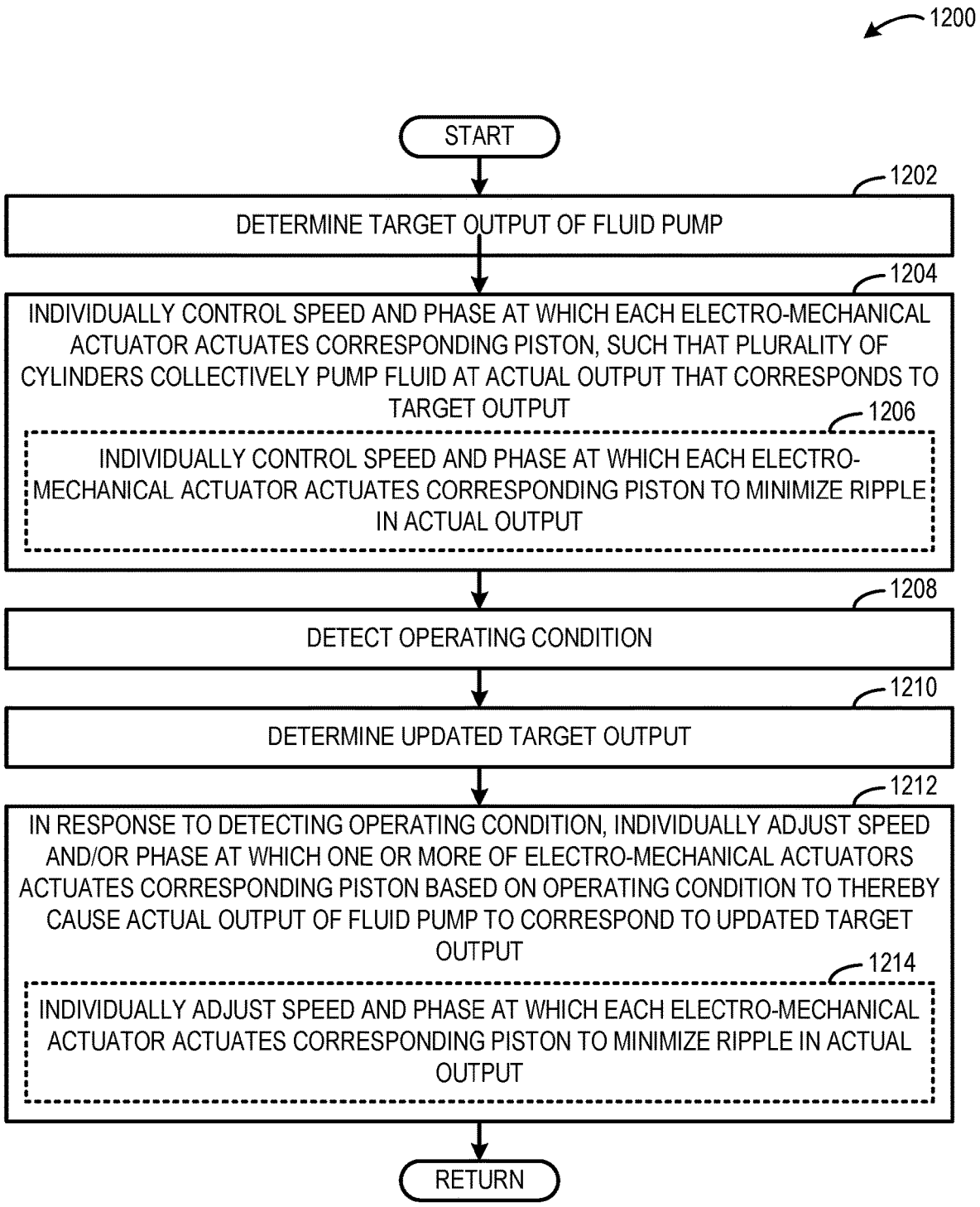
FIG. 12 shows an example method of controlling an electro-mechanical actuation system for a fluid pump.

FIG. 12 shows an example method 1200 for controlling operation of a multi-channel, electro-mechanical actuation system for fluid pump. For example, the method 1200 may be performed by the ECPU 120 shown in FIG. 1, or another control unit/computing device. At 1202, the method 1200 includes determining a target output of fluid to be pumped by the fluid pump. The target output may be determined based on various operating conditions and sensor feedback. In some examples, the target output includes one or both of a target flow rate and a target fluid pressure of fluid to be pumped by the fluid pump. In one example where the fluid pump outputs fluid to an engine, the target output is based at least in part on a target output of the engine.

At 1204, the method 1200 includes individually controlling a speed and a phase at which each electro-mechanical actuator of the electro-mechanical actuation system actuates a corresponding piston of the fluid pump, such that a plurality of cylinders of the fluid pump collectively pump fluid at an actual output that corresponds to the target output.

In some implementations, at 1206, the method 1200 optionally may include individually controlling the speed and the phase at which each electro-mechanical actuator of the electro-mechanical actuation system actuates a corresponding piston of the fluid pump in order to minimize ripple in the actual output. For example, ripple may be minimized by individually controlling the phase at which each electro-mechanical actuator actuates its corresponding piston, such that when each piston is at an end of an extend stroke another piston is at an end of a retract stroke.

At 1208, the method 1200 includes detecting an operating condition. For example, the operating condition may be determined based at least on sensor feedback of the fluid pump and/or sensor feedback of other associated components. In some examples, the operating condition is a deactivation or reduced output of one or more of the electro-mechanical actuators and/or corresponding pistons. In some examples, the deactivation or reduced output of the one or more of the electro-mechanical actuators is commanded. For example, the one or more electro-mechanical actuators may be deactivated to reduce a total output of the fluid pump, such as during an engine idle condition. In other examples, the deactivation or reduced output of the one or more of the electro-mechanical actuators is due to degradation.

At 1210, the method 1200 optionally may include determining an updated target output. The updated target output may be determined based on the operating condition and/or the operational capabilities of the fluid pump. In some examples, the updated target output includes one or both of an updated target flow rate and an updated target fluid pressure of the fluid to be pumped by the fluid pump.

At 1212, the method 1200 includes individually adjusting the speed and/or the phase at which each activated electro-mechanical actuator of the plurality of electro-mechanical actuators actuates the corresponding piston based on the detected operating condition, such that the plurality of cylinders collectively pump the fluid from the storage tank at an updated actual flow rate while minimizing ripple in the updated actual flow rate.

In some implementations, at 1214, the method 1200 optionally may include individually adjusting the speed and the phase at which each electro-mechanical actuator of the electro-mechanical actuation system actuates a corresponding piston of the fluid pump in order to minimize ripple in the actual output. For example, ripple may be minimized by individually controlling the phase at which each electro-mechanical actuator actuates its corresponding piston, such that when each piston is at an end of an extend stroke another piston is at an end of a retract stroke. The phase may be determined based on one or more operating factors of the fluid pump including overlap to compensate for check valve opening/closing, pump speed, and fluid compressibility.

In some examples where the updated target output is the same as the target output that was determined prior to detecting the operating condition, and where the operating condition is deactivation or reduced output of the one or more of the electro-mechanical actuators, the speed at which one or more other electro-mechanical actuators actuates its corresponding piston is increased to cause the actual output of the fluid pump to correspond to the updated target output.

In some examples where the target output and the updated target output are different (e.g., the updated target output is less than the target output), and where the operating condition is deactivation or reduced output of the one or more of the electro-mechanical actuators, the speed at which one or more other electro-mechanical actuators actuates its corresponding piston is reduced or maintained at the same speed to cause the actual output of the fluid pump to correspond to the updated target output. For example, the electro-mechanical actuators may be controlled at a maximum operating speed prior, and in response to detecting the operating condition where one or more of the electro-mechanical actuators is deactivated, the remaining activated electro-mechanical actuators may be maintained at the same maximum operation speed. Further, the phase of one or more of the activated electro-mechanical actuators may be adjusted to minimize ripple in the actual output of the fluid pump.

The above method may be performed to provide highly granular control of the fluid pump while providing constant output with minimized ripple over dynamically varying operating conditions.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. An electro-mechanical actuation system for a fluid pump having a plurality of cylinders, each cylinder including a piston operable to reciprocate within the cylinder to cause pumping of fluid, comprising:

a plurality of electro-mechanical actuators, each electro-mechanical actuator configured to operatively couple with a piston of the fluid pump; and a control system electrically connected to the plurality of electro-mechanical actuators and configured to:

(1) determine a target output of fluid to be pumped by the fluid pump;

(2) individually control a speed and a phase at which each electro-mechanical actuator of the plurality of electro-mechanical actuators actuates the corresponding piston of the fluid pump, such that the plurality of cylinders collectively pump fluid at an actual output that corresponds to the target output; and (3) in response to detecting an operating condition including an indication that the one or more electro-mechanical actuators and/or corresponding pistons are degrading or a deactivation or reduced output of one or more of the electro-mechanical actuators and/or corresponding pistons, individually adjust the speed and/or the phase at which one or more of the electro-mechanical actuators actuates the corresponding piston based on the operating condition, to thereby cause actual output of the fluid pump to correspond to an updated target output.

2. The electro-mechanical actuation system of claim 1, where the target output and the updated target output include one or both of a flow rate and a pressure of the fluid to be pumped by the fluid pump.

3. The electro-mechanical actuation system of claim 2, where the operating condition is one or both of the flow rate and the pressure of the fluid being pumped by the fluid pump varying by more than a threshold.

4. The electro-mechanical actuation system of claim 1, where the operating condition is a deactivation or reduced output of one or more of the electro-mechanical actuators and/or corresponding pistons.

5. The electro-mechanical actuation system of claim 4, where the updated target output is the same as the target output, and where in response to detecting the deactivation or reduced output of the one or more of the electro-mechanical actuators, the control system is configured to individually increase the speed at which the one or more electro-mechanical actuators actuates its corresponding piston to cause the actual output of the fluid pump to correspond to the updated target output.

6. The electro-mechanical actuation system of claim 4, where the updated target output is less than the target output, and where the deactivation or reduced output of the one or more of the electro-mechanical actuators is commanded by the control system.

7. The electro-mechanical actuation system of claim 4, where the speed at which each electro-mechanical actuator is controlled such that the actual output corresponds to the target output is a maximum operating speed of each electro-mechanical actuator, and where the control system is configured to, in response to detecting the operating condition, individually adjust the phase of one or more other electro-mechanical actuators and a ratio of piston extend time to piston retract time within a cycle while maintaining the one or more other electro-mechanical actuators at the maximum operating speed.

8. The electro-mechanical actuation system of claim 1, wherein the operating condition includes an indication that the one or more electro-mechanical actuators and/or corresponding pistons are degrading.

9. The electro-mechanical actuation system of claim 1, wherein the control system is configured to minimize ripple in the actual output by individually controlling the phase at which each electro-mechanical actuator actuates its corresponding piston, such that when each piston is at an end of an extend stroke another piston is at an end of a retract stroke, and wherein the phase is determined based on one or more operating factors of the fluid pump.

10. The electro-mechanical actuation system of claim 1, wherein each electro-mechanical actuator includes a motor and a screw operatively connected intermediate the motor and the corresponding piston, and wherein the motor is operable to turn the screw to reciprocate the corresponding piston.

11. A method of controlling an electro-mechanical actuation system for a fluid pump having a plurality of cylinders, each cylinder including a piston operable to reciprocate within the cylinder to cause pumping of fluid, and the electro-mechanical actuation system including a plurality of electro-mechanical actuators, each electro-mechanical actuator configured to operatively couple with a piston of the fluid pump, the method comprising:

determining a target output of fluid to be pumped by the fluid pump;

individually controlling a speed and a phase at which each electro-mechanical actuator of the plurality of electro-mechanical actuators actuates the corresponding piston of the fluid pump, such that the plurality of cylinders collectively pump fluid at an actual output that corresponds to the target output; and in response to detecting an operating condition including an indication that the one or more electro-mechanical actuators and/or corresponding pistons are degrading or a deactivation or reduced output of one or more of the electro-mechanical actuators and/or corresponding pistons, individually adjust the speed and/or the phase at which one or more of the electro-mechanical actuators actuates the corresponding piston based on the operating condition, to thereby cause actual output of the fluid pump to correspond to an updated target output.

12. The method of claim 11, where the target output and the updated target output include one or both of a flow rate and a pressure of the fluid to be pumped by the fluid pump, and where the operating condition is one or both of the flow rate and the pressure of the fluid being pumped by the fluid pump varying by more than a threshold.

13. The method of claim 11, where the operating condition is a deactivation or reduced output of one or more of the electro-mechanical actuators and/or corresponding pistons.

14. The method of claim 13, where the updated target output is the same as the target output, and where in response to detecting the deactivation or reduced output of the one or more of the electro-mechanical actuators, the method further comprises individually increasing the speed at which the one or more electro-mechanical actuators actuates its corresponding piston to cause the actual output of the fluid pump to correspond to the updated target output.

15. The method of claim 13, where the updated target output is less than the target output, and where the deactivation or reduced output of the one or more of the electro-mechanical actuators is commanded by the control system.

16. The method of claim 13, where the speed at which each electro-mechanical actuator is controlled such that the actual output corresponds to the target output is a maximum operating speed of each electro-mechanical actuator, and where the method further comprises, in response to detecting the operating condition, individually adjusting the phase of one or more other electro-mechanical actuators and a ratio of piston extend time to piston retract time within a cycle while maintaining the one or more other electro-mechanical actuators at the maximum operating speed.

17. The method of claim 11, wherein the operating condition includes an indication that the one or more electro-mechanical actuators and/or corresponding pistons are degrading.

18. The method of claim 11, wherein the method further comprises minimizing ripple in the actual output by individually controlling the phase at which each electro-mechanical actuator actuates its corresponding piston, such that when each piston is at an end of an extend stroke another piston is at an end of a retract stroke, and wherein the phase is determined based on one or more operating factors of the fluid pump.

19. An electro-mechanically driven pump system comprising:

a storage tank configured to hold a fluid;

a fluid pump including a plurality of cylinders, each cylinder including a piston operable to reciprocate within the cylinder to pump the fluid from the storage tank;

a plurality of electro-mechanical actuators, each electro-mechanical actuator operatively coupled to a corresponding piston of the plurality of cylinders and configured to actuate the corresponding piston; and a control system electrically connected to the plurality of electro-mechanical actuators and configured to:

(1) determine a target output of the fluid;

(2) individually control a speed and a phase at which each electro-mechanical actuator of the plurality of electro-mechanical actuators actuates the corresponding piston, such that the plurality of cylinders collectively pump the fluid from the storage tank at an actual output that corresponds to the target output while minimizing ripple in the actual output; and (3) in response to detecting an operating condition in which one or more of the electro-mechanical actuators and/or corresponding pistons is deactivated or has reduced output, individually adjust the speed and/or the phase at which one or more other electro-mechanical actuators of the plurality of electro-mechanical actuators actuates the corresponding piston based on the detected operating condition, such that the plurality of cylinders collectively pump the fluid from the storage tank at an updated actual output while minimizing ripple in the updated actual output.

20. The electro-mechanically driven pump system of claim 19, wherein the operating condition includes an indication that the one or more electro-mechanical actuators and/or corresponding pistons are degrading.

21. An electro-mechanical actuation system for a fluid pump having a plurality of cylinders, each cylinder including a piston operable to reciprocate within the cylinder to cause pumping of fluid, comprising:

a plurality of electro-mechanical actuators, each electro-mechanical actuator configured to operatively couple with a piston of the fluid pump; and a control system electrically connected to the plurality of electro-mechanical actuators and configured to:

(1) determine a target output of fluid to be pumped by the fluid pump;

(2) individually control a speed and a phase at which each electro-mechanical actuator of the plurality of electro-mechanical actuators actuates the corresponding piston of the fluid pump, such that the plurality of cylinders collectively pump fluid at an actual output that corresponds to the target output; and (3) in response to detecting an operating condition, individually adjust both the speed and the phase at which one or more of the electro-mechanical actuators actuates the corresponding piston based on the operating condition, to thereby cause actual output of the fluid pump to correspond to an updated target output.

22. The electro-mechanical actuation system of claim 21, where the target output and the updated target output include one or both of a flow rate and a pressure of the fluid to be pumped by the fluid pump.

23. The electro-mechanical actuation system of claim 22, where the operating condition is one or both of the flow rate and the pressure of the fluid being pumped by the fluid pump varying by more than a threshold.

24. The electro-mechanical actuation system of claim 21, where the operating condition is a deactivation or reduced output of one or more of the electro-mechanical actuators and/or corresponding pistons.

25. The electro-mechanical actuation system of claim 24, where the updated target output is the same as the target output, and where in response to detecting the deactivation or reduced output of the one or more of the electro-mechanical actuators, the control system is configured to individually increase the speed at which the one or more electro-mechanical actuators actuates its corresponding piston to cause the actual output of the fluid pump to correspond to the updated target output.

26. The electro-mechanical actuation system of claim 24, where the updated target output is less than the target output, and where the deactivation or reduced output of the one or more of the electro-mechanical actuators is commanded by the control system.

27. The electro-mechanical actuation system of claim 21, wherein the operating condition includes an indication that the one or more electro-mechanical actuators and/or corresponding pistons are degrading.

28. The electro-mechanical actuation system of claim 21, wherein the control system is configured to minimize ripple in the actual output by individually controlling the phase at which each electro-mechanical actuator actuates its corresponding piston, such that when each piston is at an end of an extend stroke another piston is at an end of a retract stroke, and wherein the phase is determined based on one or more operating factors of the fluid pump.

* * * * *